US011363385B1

(12) United States Patent
Porter

(10) Patent No.: US 11,363,385 B1
(45) Date of Patent: Jun. 14, 2022

(54) HIGH-EFFICIENCY MOTOR FOR AUDIO ACTUATION

(71) Applicant: Facebook Technologies, LLC, Menlo Park, CA (US)

(72) Inventor: Scott Porter, Woodinville, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 17/068,768

(22) Filed: Oct. 12, 2020

Related U.S. Application Data

(63) Continuation of application No. 16/198,083, filed on Nov. 21, 2018, now Pat. No. 10,812,911.

(60) Provisional application No. 62/684,734, filed on Jun. 13, 2018.

(51) Int. Cl.

| | |
|---|---|
| ***H04R 9/04*** | (2006.01) |
| ***H04R 9/02*** | (2006.01) |
| ***H04R 1/10*** | (2006.01) |
| ***H04R 3/00*** | (2006.01) |

(52) U.S. Cl.
CPC ..... *H04R 9/046* (2013.01); *H04R 1/1016* (2013.01); *H04R 3/00* (2013.01); *H04R 9/025* (2013.01); *H04R 2460/13* (2013.01)

(58) Field of Classification Search
None
See application file for complete search history.

(56) References Cited

U.S. PATENT DOCUMENTS

| | | | | |
|---|---|---|---|---|
| 10,812,911 | B2 | 10/2020 | Porter | |
| 2004/0151334 | A1 | 8/2004 | Vaudrey et al. | |
| 2007/0025574 | A1* | 2/2007 | Azi | H04R 1/1075 381/330 |
| 2007/0165887 | A1 | 7/2007 | Shin et al. | |
| 2011/0110549 | A1 | 5/2011 | Lemarquand et al. | |
| 2015/0003662 | A1 | 1/2015 | Vernon et al. | |
| 2016/0373862 | A1* | 12/2016 | Yoon | H04R 9/06 |
| 2017/0078808 | A1 | 3/2017 | Kennes | |
| 2018/0146294 | A1 | 5/2018 | Zhu et al. | |

FOREIGN PATENT DOCUMENTS

| | | |
|---|---|---|
| CN | 110601493 A | 12/2019 |

OTHER PUBLICATIONS

Non-Final Office Action received for U.S. Appl. No. 16/198,083 dated Dec. 27, 2019, 25 pages.
Notice of Allowance received for U.S. Appl. No. 16/198,083 dated Jun. 19, 2020, 25 pages.

* cited by examiner

*Primary Examiner* — Kenny H Truong
(74) *Attorney, Agent, or Firm* — FisherBroyles, LLP

(57) ABSTRACT

The disclosed high-efficiency motor may include the following: at least two magnets, a rigid structure arranged between the at least two magnets, where the rigid structure has traces configured to act as a moveable coil, and at least two couplings that respectively link the magnets to the rigid structure in a flexible manner. An electrical input signal applied to the moveable coil may cause motive force to be applied the rigid structure according to the input signal, so that the rigid structure moves orthogonally relative to the magnets as driven by the input signal. In this manner, the high-efficiency motor may be incorporated into a system that may reproduce a full-range audio signal. Various other methods, systems, and computer-readable media are also disclosed.

20 Claims, 9 Drawing Sheets

HIGH-EFFICIENCY MOTOR FOR AUDIO ACTUATION

CROSS REFERENCE TO RELATED APPLICATION

This application is a continuation of U.S. application Ser. No. 16/198,083, filed 21 Nov. 2018 which claims the benefit of U.S. Application 62/684,734, filed 13 Jun. 2018. The disclosure of which is incorporated, in its entirety, by this reference.

BACKGROUND

Many different types of acoustic sources may be used to reproduce music, speech or other audio sources. For example, a typical pair of headphones uses a voice coil and a diaphragm to convert an audio input signal into sound waves. The voice coil is usually positioned within a circular gap between the poles of a permanent magnet. When the electrical audio signal is applied to the coil, the coil moves back and forth. The diaphragm is connected to the coil and, as such, moves with the coil. The movement of the diaphragm pushes on the surrounding air to create sound waves that are heard by the wearer of the headphones. This configuration, however, may not be suitable in some driver applications.

SUMMARY

As will be described in greater detail below, the instant disclosure describes a high-efficiency motor that seeks to maximize the length of wire (L) that can be arranged perpendicular to a given magnetic B-field with a minimum electrical resistance of the coil. In at least some of the embodiments herein, this motor includes a rigid structure such as a printed circuit board (PCB) positioned between two (or more) magnets. The PCB may include traces that act as a moveable coil. Because the traces are thin, the magnets may be placed closer together, thereby increasing the magnetic B-field. Moreover, because the traces can be significantly wider than they are thick, they can be longer, thereby increasing the conductor length (L) for a given resistance. Accordingly, because of the relatively high (B) and (L) in the BL motor, the high-efficiency motor may provide an increased amount of mechanical output power per amount of input electrical power applied. As will be explained further below, the embodiments herein may increase the magnetic B-field and/or the conductor length (L) to provide a motor that can be used in a variety of applications, including use as a driver of a pistonic acoustic radiator.

In one example, a high-efficiency motor may include the following: at least two magnets, a rigid structure arranged between the at least two magnets, where the rigid structure has traces configured to act as a moveable coil, and at least one coupling that links the magnets to the rigid structure in a flexible manner. An electrical input signal applied to the moveable coil may cause motive force to be applied the rigid structure according to the input signal, so that the rigid structure moves orthogonally relative to the magnets as driven by the input signal.

In some examples, the magnets may be arranged opposite each other, with each magnet having the same magnetic polarity. In some examples, the pistonic acoustic radiator system may include a mounting plate to which at least one of the magnets is mounted. In some cases, this mounting plate serves as a magnetic return path for the system. In some examples, the pistonic acoustic radiator system may include at least four magnets. In such cases, two of the magnets may be mounted to a mounting plate on one side of the rigid structure, and two of the magnets may be mounted to another mounting plate on an opposite side of the rigid structure. In some examples, the pistonic acoustic radiator system may include four couplings, where each of the four couplings is respectively connected to one of the four magnets and to the rigid structure.

In some examples, the rigid structure may be a printed circuit board (PCB). The printed circuit board may move orthogonally relative to the magnets, commensurate with an amount of energy in the electrical input signal. The traces of the moveable voice coil may be applied to the printed circuit board using a pattern of conductive traces (e.g., a wound pancake coil or printed pancake coil in a flexible printed circuit (FPC)) bonded to a rigid substrate. In some examples, an ear piece designed for contact with a user's ear may be affixed to the printed circuit board. In such examples, the ear piece may vibrate the user's pinna and/or tragal cartilage to reproduce an audio source signal. In some examples, the motor may include at least one ferrofluid configured to dissipate heat within the system. In some examples, the moveable coil may be a pancake coil.

In some examples, the rigid structure may have an ear piece attached thereto. The ear piece may be configured to vibrate a listener's pinna and/or tragal cartilage. In some examples, the generated input signal may be modulated according to an audio signal that is to be transmitted to a listener. In some examples, the rigid structure (e.g., a PCB) may be attached to the magnets using metal flexures. In some examples, the metal flexures may operate as electrical contacts for the moveable coil.

In one example, a computer-implemented method for reproducing an audio source using a pistonic acoustic radiator may include determining that a rigid structure is to be moved in a specified manner. The rigid structure may be arranged between at least two magnets, and the rigid structure may include traces configured to act as a moveable coil. The method may further include generating an input signal that is to be applied to the moveable coil. The moveable coil may be configured to apply a motive force to the rigid structure according to the generated input signal. The method may next include providing the generated input signal to the moveable coil, so that the rigid structure is moved in the specified manner.

In some examples, the above-described method may be encoded as computer-readable instructions on a computer-readable medium. For example, a computer-readable medium may include one or more computer-executable instructions that, when executed by at least one processor of a computing device, may cause the computing device to determine that a rigid structure is to be moved in a specified manner. The rigid structure may be arranged between at least two magnets, and the rigid structure may include traces configured to act as a moveable coil. The computing device may then generate an input signal that is to be applied to the moveable coil. The moveable coil may be configured to apply a motive force to the rigid structure according to the generated input signal. The computing device may then provide the generated input signal to the moveable coil, so that the rigid structure is moved in the specified manner.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
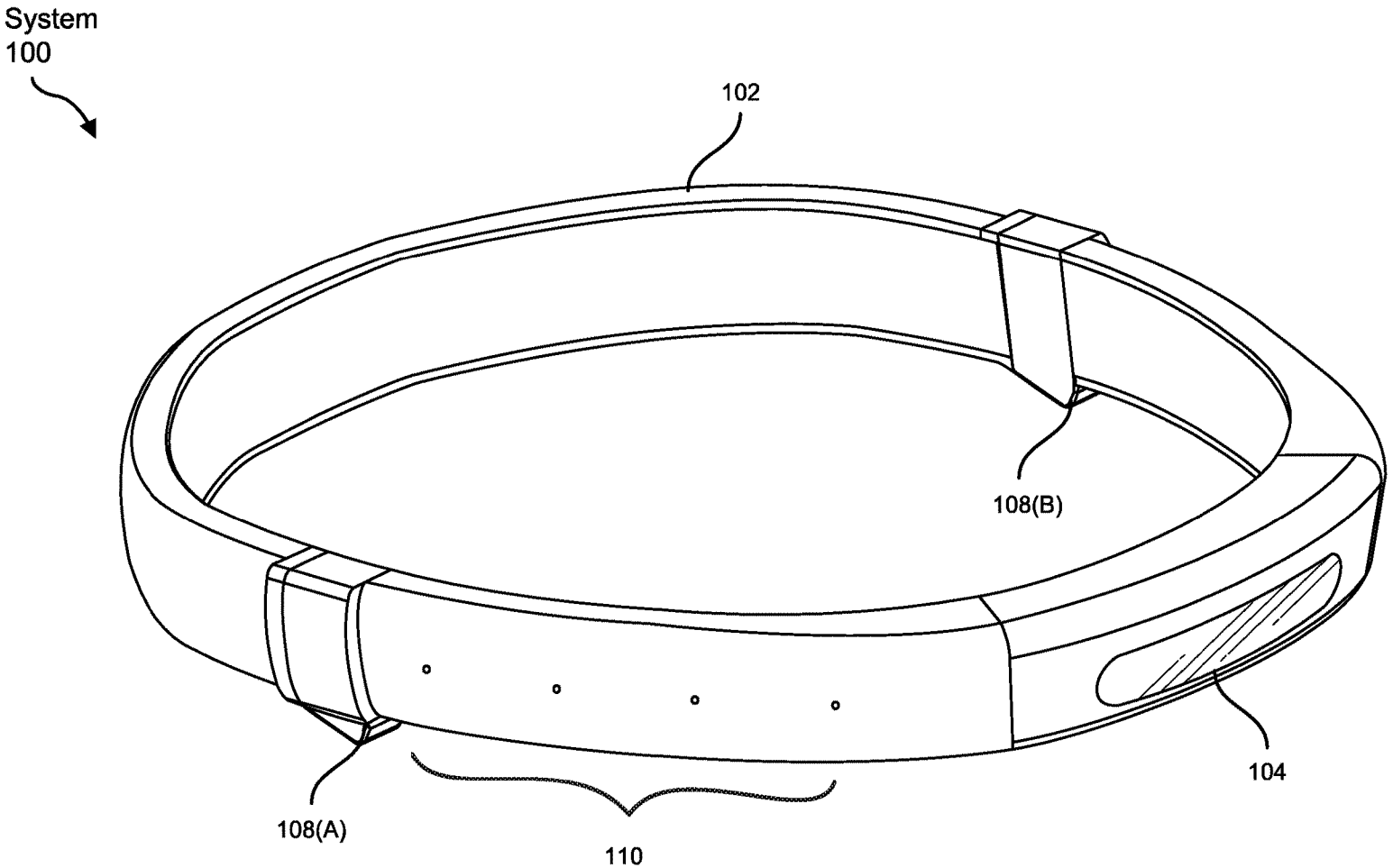
FIG. 1 illustrates an embodiment of an artificial reality headset.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The present disclosure is generally directed to a high-efficiency motor and to reproducing an audio source using a pistonic acoustic radiator. As will be explained in greater detail below, embodiments of the instant disclosure may include a pistonic acoustic radiator that is configured to transduce an audio signal into pistonic movements that vibrate a user's pinna. These vibrations of the user's pinna cause the pinna to act as the acoustic radiator, thereby reproducing the audio signal in the user's ear. Traditional headphones, ear buds and other speakers propagate sound waves by pushing on air. These headphones and ear buds are often audible to other users that are nearby. Because the embodiments herein vibrate the user's ears directly, transmission of sound waves through the air can be avoided, resulting in increased privacy to the user.

In some embodiments, the motor driving the pistonic acoustic radiator may be an electrodynamic (moving-coil) motor and, in some cases, the electrodynamic motor is a Lorentz-force principle motor. A Lorentz-force principle motor generally applies a current to a coil of conductive material situated between permanent magnets of opposite polarity. As current travels through the coil, a force is produced in a direction orthogonal to the coil. The amount of force, or "force factor." of an electrodynamic, Lorentz-force principle motor is the product of magnetic induction (B) and the length of the conductor (L) immersed in a magnetic B-field. The force factor may be measured in newtons/ampere, indicating that the amount of mechanical force produced is dependent on the amount of electrical current provided.

Some past implementations of pistonic acoustic systems have used Lorentz-force motors to provide vibration alerts. The Lorentz-force motors receive an actuation signal and provide a monotonic vibration alert. Such implementations may lack the magnetic induction (B) and or the voice coil length (L) to drive a user's pinna to properly transmit an audio wave to a user. Moreover, these past implementations may lack the ability to reproduce audio across a wide spectrum of audible frequencies. The embodiments herein may be designed with a level of B-field and/or voice coil length (or a combined "BL") that allow the electrodynamic motor to actively drive the user's pinna (or other cartilage) as a pistonic acoustic radiator to reproduce a wide spectrum of audible frequencies, while still fitting into a form factor that can fit into a user's ear or around the outside of a user's ear.

Embodiments of the instant disclosure may include or be implemented in conjunction with various types of artificial reality systems. Artificial reality is a form of reality that has been adjusted in some manner before presentation to a user, which may include, e.g., a virtual reality (VR), an augmented reality (AR), a mixed reality (MR), a hybrid reality, or some combination and/or derivative thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., to perform activities in) an artificial reality.

Artificial reality systems may be implemented in a variety of different form factors and configurations. Some artificial reality systems may be designed to work without near-eye displays (NEDs), an example of which is AR system 100 in FIG. 1. Other artificial reality systems may include an NED that also provides visibility into the real world (e.g., AR system 200 in FIG. 2) or that visually immerses a user in an artificial reality (e.g., VR system 300 in FIG. 3). While some artificial reality devices may be self-contained systems, other artificial reality devices may communicate and/or coordinate with external devices to provide an artificial reality experience to a user. Examples of such external devices include handheld controllers, mobile devices, desktop computers, devices worn by a user, devices worn by one or more other users, and/or any other suitable external system.

Turning to FIG. 1, AR system 100 generally represents a wearable device dimensioned to fit about a body part (e.g., a head) of a user. As shown in FIG. 1, system 100 may include a frame 102 and a camera assembly 104 that is coupled to frame 102 and configured to gather information about a local environment by observing the local environment. AR system 100 may also include one or more audio devices, such as output audio transducers 108(A) and 108(B) and input audio transducers 110. Output audio transducers 108(A) and 108(B) may provide audio feedback and/or content to a user, and input audio transducers 110 may capture audio in a user's environment.

As shown, AR system 100 may not necessarily include an NED positioned in front of a user's eyes. AR systems without NEDs may take a variety of forms, such as head bands, hats, hair bands, belts, watches, wrist bands, ankle bands, rings, neckbands, necklaces, chest bands, eyewear frames, and/or any other suitable type or form of apparatus. While AR system 100 may not include an NED, AR system 100 may include other types of screens or visual feedback devices (e.g., a display screen integrated into a side of frame 102).

Figure 2:
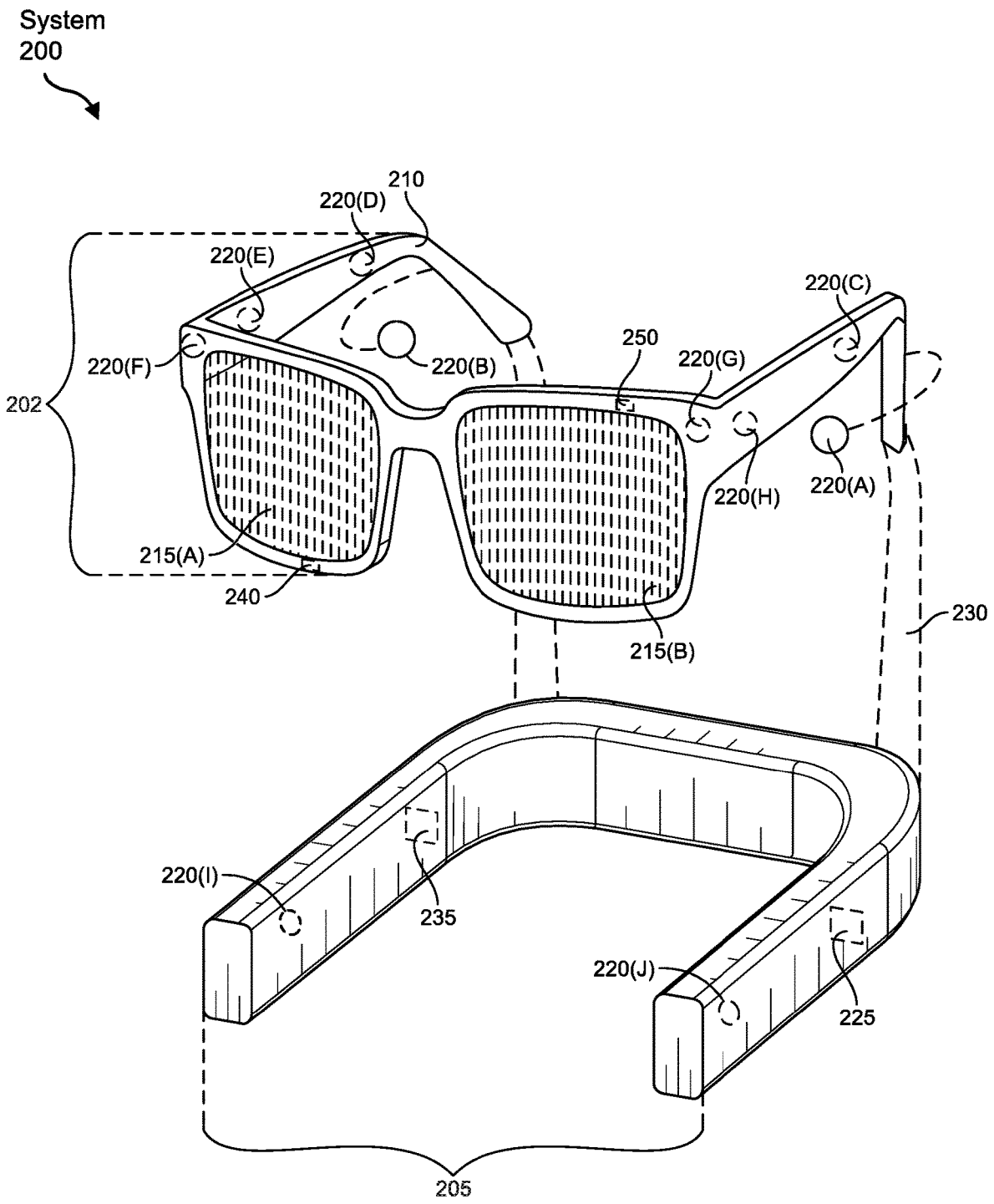
FIG. 2 illustrates an embodiment of an augmented reality headset and corresponding neckband.

The embodiments discussed in this disclosure may also be implemented in AR systems that include one or more NEDs. For example, as shown in FIG. 2, AR system 200 may include an eyewear device 202 with a frame 210 configured to hold a left display device 215(A) and a right display device 215(B) in front of a user's eyes. Display devices 215(A) and 215(B) may act together or independently to present an image or series of images to a user. While AR system 200 includes two displays, embodiments of this disclosure may be implemented in AR systems with a single NED or more than two NEDs.

In some embodiments, AR system 200 may include one or more sensors, such as sensor 240. Sensor 240 may generate measurement signals in response to motion of AR system 200 and may be located on substantially any portion of frame 210. Sensor 240 may include a position sensor, an inertial measurement unit (IMU), a depth camera assembly, or any combination thereof. In some embodiments, AR system 200 may or may not include sensor 240 or may include more than one sensor. In embodiments in which sensor 240 includes an IMU, the IMU may generate calibration data based on measurement signals from sensor 240. Examples of sensor 240 may include, without limitation, accelerometers, gyroscopes, magnetometers, other suitable types of sensors that detect motion, sensors used for error correction of the IMU, or some combination thereof.

AR system 200 may also include a microphone array with a plurality of acoustic sensors 220(A)-220(J), referred to collectively as acoustic sensors 220. Acoustic sensors 220 may be transducers that detect air pressure variations induced by sound waves. Each acoustic sensor 220 may be configured to detect sound and convert the detected sound into an electronic format (e.g., an analog or digital format). The microphone array in FIG. 2 may include, for example, ten acoustic sensors: 220(A) and 220(B), which may be designed to be placed inside a corresponding ear of the user, acoustic sensors 220(C), 220(D), 220(E), 220(F), 220(G), and 220(H), which may be positioned at various locations on frame 210, and/or acoustic sensors 220(I) and 220(J), which may be positioned on a corresponding neckband 205.

The configuration of acoustic sensors 220 of the microphone array may vary. While AR system 200 is shown in FIG. 2 as having ten acoustic sensors 220, the number of acoustic sensors 220 may be greater or less than ten. In some embodiments, using higher numbers of acoustic sensors 220 may increase the amount of audio information collected and/or the sensitivity and accuracy of the audio information. In contrast, using a lower number of acoustic sensors 220 may decrease the computing power required by the controller 250 to process the collected audio information. In addition, the position of each acoustic sensor 220 of the microphone array may vary. For example, the position of an acoustic sensor 220 may include a defined position on the user, a defined coordinate on the frame 210, an orientation associated with each acoustic sensor, or some combination thereof.

Acoustic sensors 220(A) and 220(B) may be positioned on different parts of the user's ear, such as behind the pinna or within the auricle or fossa. Or, there may be additional acoustic sensors on or surrounding the ear in addition to acoustic sensors 220 inside the ear canal. Having an acoustic sensor positioned next to an ear canal of a user may enable the microphone array to collect information on how sounds arrive at the ear canal. By positioning at least two of acoustic sensors 220 on either side of a user's head (e.g., as binaural microphones), AR device 200 may simulate binaural hearing and capture a 3D stereo sound field around about a user's head. In some embodiments, the acoustic sensors 220(A) and 220(B) may be connected to the AR system 200 via a wired connection, and in other embodiments, the acoustic sensors 220(A) and 220(B) may be connected to the AR system 200 via a wireless connection (e.g., a Bluetooth connection). In still other embodiments, the acoustic sensors 220(A) and 220(B) may not be used at all in conjunction with the AR system 200.

Acoustic sensors 220 on frame 210 may be positioned along the length of the temples, across the bridge, above or below display devices 215(A) and 215(B), or some combination thereof. Acoustic sensors 220 may be oriented such that the microphone array is able to detect sounds in a wide range of directions surrounding the user wearing the AR system 200. In some embodiments, an optimization process may be performed during manufacturing of AR system 200 to determine relative positioning of each acoustic sensor 220 in the microphone array.

AR system 200 may further include or be connected to an external device. (e.g., a paired device), such as neckband 205. As shown, neckband 205 may be coupled to eyewear device 202 via one or more connectors 230. The connectors 230 may be wired or wireless connectors and may include electrical and/or non-electrical (e.g., structural) components. In some cases, the eyewear device 202 and the neckband 205 may operate independently without any wired or wireless connection between them. While FIG. 2 illustrates the components of eyewear device 202 and neckband 205 in example locations on eyewear device 202 and neckband 205, the components may be located elsewhere and/or distributed differently on eyewear device 202 and/or neckband 205. In some embodiments, the components of the eyewear device 202 and neckband 205 may be located on one or more additional peripheral devices paired with eyewear device 202, neckband 205, or some combination thereof. Furthermore, neckband 205 generally represents any type or form of paired device. Thus, the following discussion of neckband 205 may also apply to various other paired devices, such as smart watches, smart phones, wrist bands, other wearable devices, hand-held controllers, tablet computers, laptop computers, etc.

Pairing external devices, such as neckband 205, with AR eyewear devices may enable the eyewear devices to achieve the form factor of a pair of glasses while still providing sufficient battery and computation power for expanded capabilities. Some or all of the battery power, computational resources, and/or additional features of AR system 200 may be provided by a paired device or shared between a paired device and an eyewear device, thus reducing the weight, heat profile, and form factor of the eyewear device overall while still retaining desired functionality. For example, neckband 205 may allow components that would otherwise be included on an eyewear device to be included in neckband 205 since users may tolerate a heavier weight load on their shoulders than they would tolerate on their heads. Neckband 205 may also have a larger surface area over which to diffuse and disperse heat to the ambient environment. Thus, neckband 205 may allow for greater battery and computation capacity than might otherwise have been possible on a stand-alone eyewear device. Since weight carried in neckband 205 may be less invasive to a user than weight carried in eyewear device 202, a user may tolerate wearing a lighter eyewear device and carrying or wearing the paired device for greater lengths of time than the user would tolerate wearing a heavy standalone eyewear device, thereby enabling an artificial reality environment to be incorporated more fully into a user's day-to-day activities.

Neckband 205 may be communicatively coupled with eyewear device 202 and/or to other devices. The other devices may provide certain functions (e.g., tracking, localizing, depth mapping, processing, storage, etc.) to the AR system 200. In the embodiment of FIG. 2, neckband 205 may include two acoustic sensors (e.g., 220(1) and 220(J)) that are part of the microphone array (or potentially form their own microphone subarray). Neckband 205 may also include a controller 225 and a power source 235.

Acoustic sensors 220(1) and 220(J) of neckband 205 may be configured to detect sound and convert the detected sound into an electronic format (analog or digital). In the embodiment of FIG. 2, acoustic sensors 220(1) and 220(J) may be positioned on neckband 205, thereby increasing the distance between the neckband acoustic sensors 220(1) and 220(J) and other acoustic sensors 220 positioned on eyewear device 202. In some cases, increasing the distance between acoustic sensors 220 of the microphone array may improve the accuracy of beamforming performed via the microphone array. For example, if a sound is detected by acoustic sensors 220(C) and 220(D) and the distance between acoustic sensors 220(C) and 220(D) is greater than, e.g., the distance between acoustic sensors 220(D) and 220(E), the determined source location of the detected sound may be more accurate than if the sound had been detected by acoustic sensors 220(D) and 220(E).

Controller 225 of neckband 205 may process information generated by the sensors on neckband 205 and/or AR system 200. For example, controller 225 may process information from the microphone array that describes sounds detected by the microphone array. For each detected sound, controller 225 may perform a DoA estimation to estimate a direction from which the detected sound arrived at the microphone array. As the microphone array detects sounds, controller 225 may populate an audio data set with the information. In embodiments in which AR system 200 includes an inertial measurement unit, controller 225 may compute all inertial and spatial calculations from the IMU located on eyewear device 202. Connector 230 may convey information between AR system 200 and neckband 205 and between AR system 200 and controller 225. The information may be in the form of optical data, electrical data, wireless data, or any other transmittable data form. Moving the processing of information generated by AR system 200 to neckband 205 may reduce weight and heat in eyewear device 202, making it more comfortable to the user.

Power source 235 in neckband 205 may provide power to eyewear device 202 and/or to neckband 205. Power source 235 may include, without limitation, lithium ion batteries, lithium-polymer batteries, primary lithium batteries, alkaline batteries, or any other form of power storage. In some cases, power source 235 may be a wired power source. Including power source 235 on neckband 205 instead of on eyewear device 202 may help better distribute the weight and heat generated by power source 235.

As noted, some artificial reality systems may, instead of blending an artificial reality with actual reality, substantially replace one or more of a user's sensory perceptions of the real world with a virtual experience. One example of this type of system is a head-worn display system, such as VR system 300 in FIG. 3, that mostly or completely covers a user's field of view. VR system 300 may include a front rigid body 302 and a band 304 shaped to fit around a user's head. VR system 300 may also include output audio transducers 306(A) and 306(B). Furthermore, while not shown in FIG. 3, front rigid body 302 may include one or more electronic elements, including one or more electronic displays, one or more inertial measurement units (IMUS), one or more tracking emitters or detectors, and/or any other suitable device or system for creating an artificial reality experience.

Artificial reality systems may include a variety of types of visual feedback mechanisms. For example, display devices in AR system 200 and/or VR system 300 may include one or more liquid crystal displays (LCDs), light emitting diode (LED) displays, organic LED (OLED) displays, and/or any other suitable type of display screen. Artificial reality systems may include a single display screen for both eyes or may provide a display screen for each eye, which may allow for additional flexibility for varifocal adjustments or for correcting a user's refractive error. Some artificial reality systems may also include optical subsystems having one or more lenses (e.g., conventional concave or convex lenses, Fresnel lenses, adjustable liquid lenses, etc.) through which a user may view a display screen.

In addition to or instead of using display screens, some artificial reality systems may include one or more projection systems. For example, display devices in AR system 200 and/or VR system 300 may include micro-LED projectors that project light (using, e.g., a waveguide) into display devices, such as clear combiner lenses that allow ambient light to pass through. The display devices may refract the projected light toward a user's pupil and may enable a user to simultaneously view both artificial reality content and the real world. Artificial reality systems may also be configured with any other suitable type or form of image projection system.

Artificial reality systems may also include various types of computer vision components and subsystems. For example, AR system 100, AR system 200, and/or VR system 300 may include one or more optical sensors such as two-dimensional (2D) or three-dimensional (3D) cameras, time-of-flight depth sensors, single-beam or sweeping laser rangefinders, 3D LiDAR sensors, and/or any other suitable type or form of optical sensor. An artificial reality system may process data from one or more of these sensors to identify a location of a user, to map the real world, to provide a user with context about real-world surroundings, and/or to perform a variety of other functions.

Artificial reality systems may also include one or more input and/or output audio transducers. In the examples shown in FIGS. 1 and 3, output audio transducers 108(A), 108(B), 306(A), and 306(B) may include voice coil speakers, ribbon speakers, electrostatic speakers, piezoelectric speakers, bone conduction transducers, cartilage conduction transducers, and/or any other suitable type or form of audio transducer. Similarly, input audio transducers 110 may include condenser microphones, dynamic microphones, ribbon microphones, and/or any other type or form of input transducer. In some embodiments, a single transducer may be used for both audio input and audio output.

Figure 3:
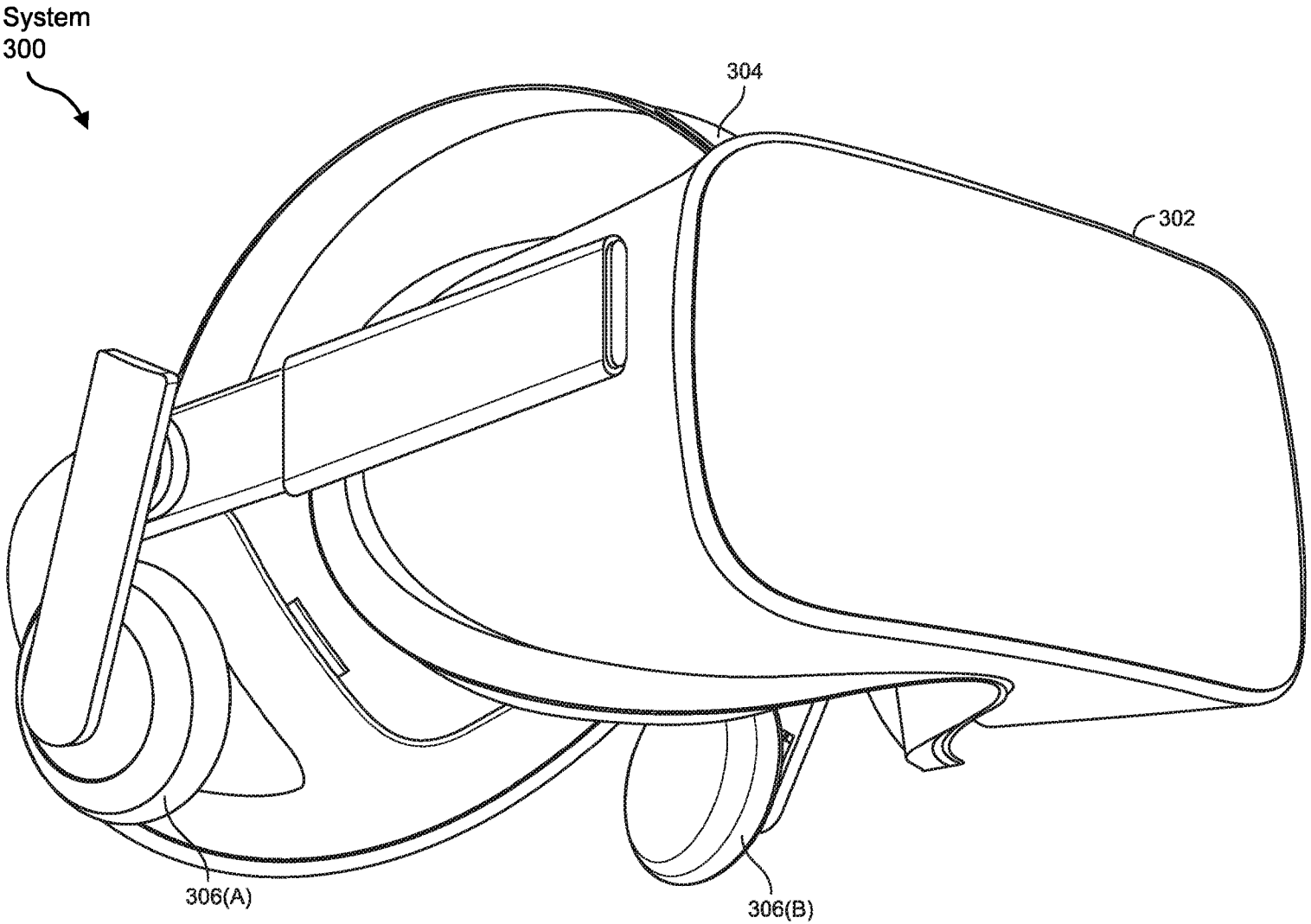
FIG. 3 illustrates an embodiment of a virtual reality headset.

While not shown in FIGS. 1-3, artificial reality systems may include tactile (i.e., haptic) feedback systems, which may be incorporated into headwear, gloves, body suits, handheld controllers, environmental devices (e.g., chairs, floormats, etc.), and/or any other type of device or system. Haptic feedback systems may provide various types of cutaneous feedback, including vibration, force, traction, texture, and/or temperature. Haptic feedback systems may also provide various types of kinesthetic feedback, such as motion and compliance. Haptic feedback may be implemented using motors, piezoelectric actuators, fluidic systems, and/or a variety of other types of feedback mechanisms. Haptic feedback systems may be implemented independent of other artificial reality devices, within other artificial reality devices, and/or in conjunction with other artificial reality devices.

By providing haptic sensations, audible content, and/or visual content, artificial reality systems may create an entire virtual experience or enhance a user's real-world experience in a variety of contexts and environments. For instance, artificial reality systems may assist or extend a user's perception, memory, or cognition within a particular environment. Some systems may enhance a user's interactions with other people in the real world or may enable more immersive interactions with other people in a virtual world. Artificial reality systems may also be used for educational purposes (e.g., for teaching or training in schools, hospitals, government organizations, military organizations, business enterprises, etc.), entertainment purposes (e.g., for playing video games, listening to music, watching video content, etc.), and/or for accessibility purposes (e.g., as hearing aids, visuals aids, etc.). The embodiments disclosed herein may enable or enhance a user's artificial reality experience in one or more of these contexts and environments and/or in other contexts and environments.

Some AR systems may map a user's environment using techniques referred to as "simultaneous location and mapping" (SLAM). SLAM mapping and location identifying techniques may involve a variety of hardware and software tools that can create or update a map of an environment while simultaneously keeping track of a user's location within the mapped environment. SLAM may use many different types of sensors to create a map and determine a user's position within the map.

SLAM techniques may, for example, implement optical sensors to determine a user's location. Radios including WiFi, Bluetooth, global positioning system (GPS), cellular or other communication devices may be also used to determine a user's location relative to a radio transceiver or group of transceivers (e.g., a WiFi router or group of GPS satellites). Acoustic sensors such as microphone arrays or 2D or 3D sonar sensors may also be used to determine a user's location within an environment. AR and VR devices (such as systems 100, 200, and 300 of FIGS. 1 and 2, respectively) may incorporate any or all of these types of sensors to perform SLAM operations such as creating and continually updating maps of the user's current environment. In at least some of the embodiments described herein, SLAM data generated by these sensors may be referred to as "environmental data" and may indicate a user's current environment. This data may be stored in a local or remote data store (e.g., a cloud data store) and may be provided to a user's AR/VR device on demand.

When the user is wearing an AR headset or VR headset in a given environment, the user may be interacting with other users or other electronic devices that serve as audio sources. In some cases, it may be desirable to determine where the audio sources are located relative to the user and then present the audio sources to the user as if they were coming from the location of the audio source. The process of determining where the audio sources are located relative to the user may be referred to herein as "localization," and the process of rendering playback of the audio source signal to appear as if it is coming from a specific direction may be referred to herein as "spatialization."

Localizing an audio source may be performed in a variety of different ways. In some cases, an AR or VR headset may initiate a direction of arrival (DOA) analysis to determine the location of a sound source. The DOA analysis may include analyzing the intensity, spectra, and/or arrival time of each sound at the AR/VR device to determine the direction from which the sounds originated. In some cases, the DOA analysis may include any suitable algorithm for analyzing the surrounding acoustic environment in which the artificial reality device is located.

For example, the DOA analysis may be designed to receive input signals from a microphone and apply digital signal processing algorithms to the input signals to estimate the direction of arrival. These algorithms may include, for example, delay and sum algorithms where the input signal is sampled, and the resulting weighted and delayed versions of the sampled signal are averaged together to determine a direction of arrival. A least mean squared (LMS) algorithm may also be implemented to create an adaptive filter. This adaptive filter may then be used to identify differences in signal intensity, for example, or differences in time of arrival. These differences may then be used to estimate the direction of arrival. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct-path audio signal. Those bins having a portion of the direct-path signal may then be analyzed to identify the angle at which a microphone array received the direct-path audio signal. The determined angle may then be used to identify the direction of arrival for the received input signal. Other algorithms not listed above may also be used alone or in combination with the above algorithms to determine DOA.

In some embodiments, different users may perceive the source of a sound as coming from slightly different locations. This may be the result of each user having a unique head-related transfer function (HRTF), which may be dictated by a user's anatomy including ear canal length and the positioning of the ear drum. The artificial reality device may provide an alignment and orientation guide, which the user may follow to customize the sound signal presented to the user based on their unique HRTF. In some embodiments, an artificial reality device may implement one or more microphones to listen to sounds within the user's environment. The AR or VR headset may use a variety of different array transfer functions (e.g., any of the DOA algorithms identified above) to estimate the direction of arrival for the sounds. Once the direction of arrival has been determined, the artificial reality device may play back sounds to the user according to the user's unique HRTF. Accordingly, the DOA estimation generated using the array transfer function (ATF) may be used to determine the direction from which the sounds are to be played from. The playback sounds may be further refined based on how that specific user hears sounds according to the HRTF.

In addition to or as an alternative to performing a DOA estimation, an artificial reality device may perform localization based on information received from other types of sensors. These sensors may include cameras, IR sensors, heat sensors, motion sensors, GPS receivers, or in some cases, sensor that detect a user's eye movements. For example, as noted above, an artificial reality device may include an eye tracker or gaze detector that determines where the user is looking. Often, the user's eyes will look at the source of the sound, if only briefly. Such clues provided by the user's eyes may further aid in determining the location of a sound source. Other sensors such as cameras, heat sensors, and IR sensors may also indicate the location of a user, the location of an electronic device, or the location of another sound source. Any or all of the above methods may be used individually or in combination to determine the location of a sound source and may further be used to update the location of a sound source over time.

Some embodiments may implement the determined DOA to generate a more customized output audio signal for the user. For instance, an "acoustic transfer function" may characterize or define how a sound is received from a given location. More specifically, an acoustic transfer function may define the relationship between parameters of a sound at its source location and the parameters by which the sound signal is detected (e.g., detected by a microphone array or detected by a user's ear). An artificial reality device may include one or more acoustic sensors that detect sounds within range of the device. A controller of the artificial reality device may estimate a DOA for the detected sounds (using, e.g., any of the methods identified above) and, based on the parameters of the detected sounds, may generate an acoustic transfer function that is specific to the location of the device. This customized acoustic transfer function may thus be used to generate a spatialized output audio signal where the sound is perceived as coming from a specific location.

Indeed, once the location of the sound source or sources is known, the artificial reality device may re-render (i.e., spatialize) the sound signals to sound as if coming from the direction of that sound source. The artificial reality device may apply filters or other digital signal processing that alter the intensity, spectra, or arrival time of the sound signal. The digital signal processing may be applied in such a way that the sound signal is perceived as originating from the determined location. The artificial reality device may amplify or subdue certain frequencies or change the time that the signal arrives at each ear. In some cases, the artificial reality device may create an acoustic transfer function that is specific to the location of the device and the detected direction of arrival of the sound signal. In some embodiments, the artificial reality device may re-render the source signal in a stereo device or multi-speaker device (e.g., a surround sound device). In such cases, separate and distinct audio signals may be sent to each speaker. Each of these audio signals may be altered according to the user's HRTF and according to measurements of the user's location and the location of the sound source to sound as if they are coming from the determined location of the sound source. Accordingly, in this manner, the artificial reality device (or speakers associated with the device) may re-render an audio signal to sound as if originating from a specific location.

Figure 4:
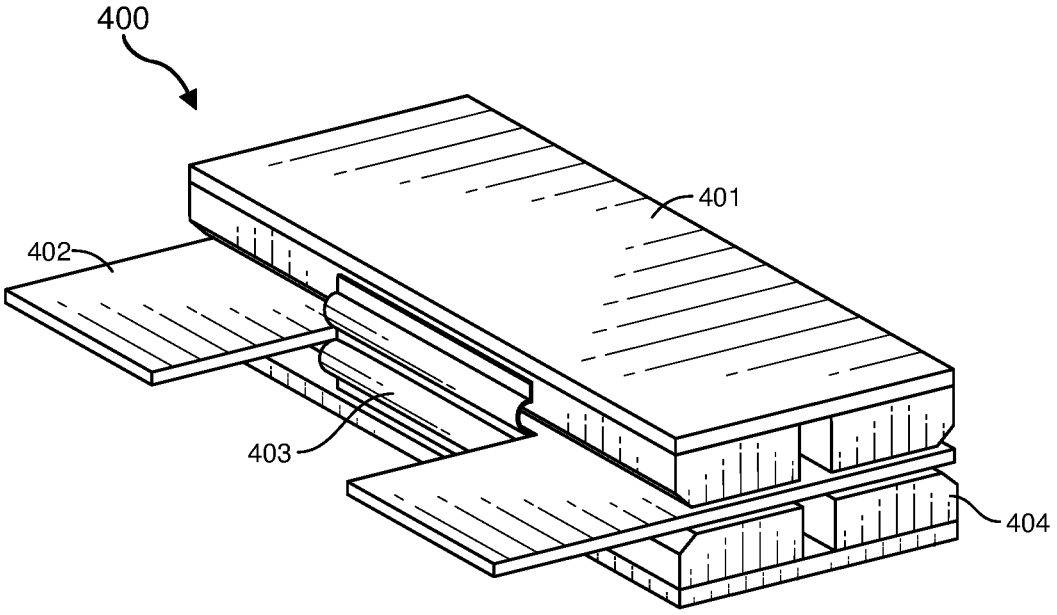
FIG. 4 illustrates a perspective view of an embodiment of a high-efficiency motor for reproducing an audio source.
Figure 5:
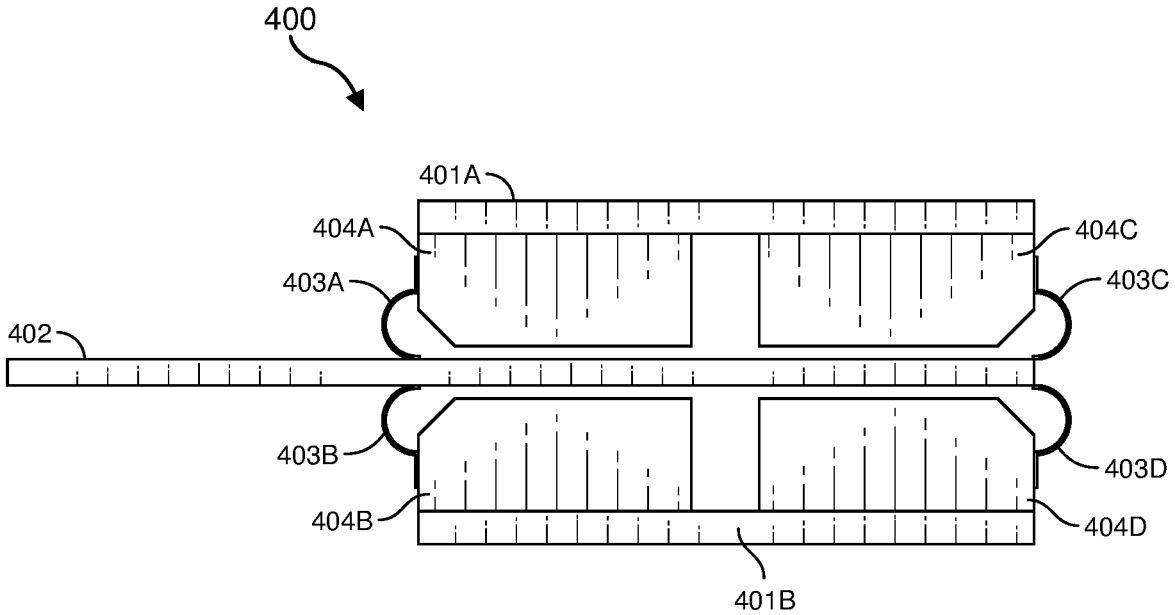
FIG. 5 illustrates a side view of an embodiment of a high-efficiency motor for reproducing an audio source.
Figure 6:
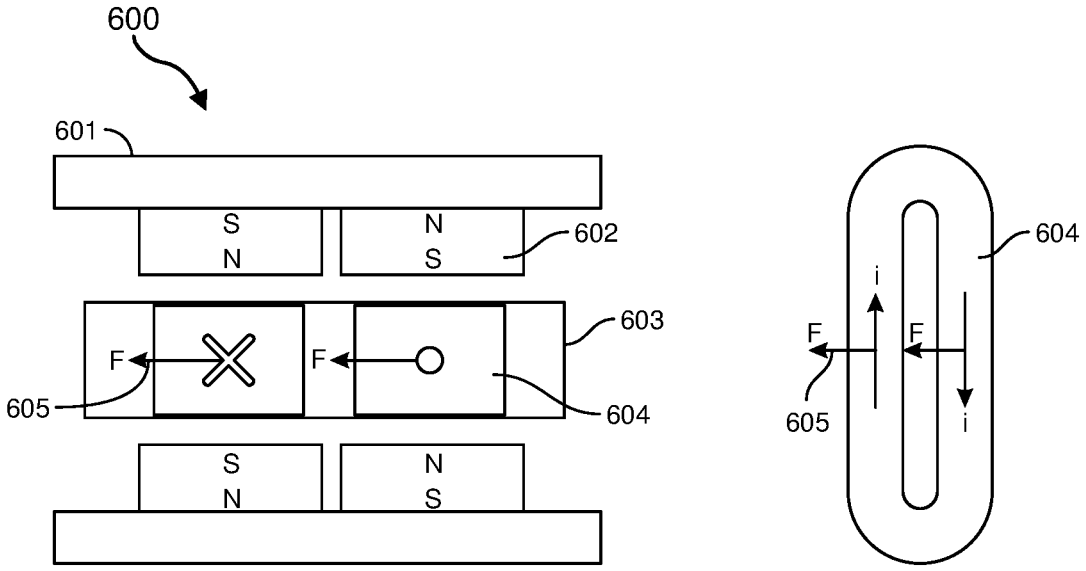
FIG. 6 illustrates an alternative side view of an embodiment of a high-efficiency motor for reproducing an audio source.

FIG. 4 illustrates an embodiment of a high-efficiency motor 400. The embodiment illustrated in FIG. 4 may include magnets 404. In some cases, the motor 400 may include four magnets, where two sets of magnets are arranged opposing each other, each set of magnets having an aligned polarity. For instance, as shown in FIG. 5 (which is a side view of the motor 400 of FIG. 4), magnets 404A and 404B may each be arranged with the south pole over the north pole (S/N). As such, the north pole of magnet 404A and the south pole of magnet 404B would be facing each other in an aligned polarity. In such an embodiment, magnets 404C and 404D may be arranged in the opposite fashion, with magnets 404C and 404D having the north pole over the south pole (N/S). As such, the south pole of magnet 404C and the north pole of magnet 404D would be facing each other. Any or all of these magnets may be permanent magnets. Still further, it will be recognized that although four magnets are illustrated in FIGS. 4-6, two opposing magnets may be used, or six or more opposing magnets may be used in the embodiments herein.

Returning to FIG. 4, the high-efficiency motor 400 may further include a rigid structure 402 arranged between the magnets. The rigid structure 402 may include one or more traces configured to act as a moveable coil. For example, the rigid structure 402 may be a printed circuit board (PCB) or other structure that is sufficiently rigid to receive forces applied thereto (e.g., Lorentz forces) and vibrate according to frequencies designated in an input signal. In some embodiments, the rigid structure 402 may have traces embedded in its structure. Or, the traces may be applied on top of the rigid structure using flexible printed circuitry (FPC) or other similar manner.

For example, as will be explained further below with regard to FIG. 8, the rigid structure may have a moveable coil 700 deposited thereon. The moveable coil may include one or more electrically conductive traces 701. These conductive traces 701 may begin at a certain point and wrap around to a finishing point. As current passes through the traces according to the input signal, a Lorentz force may be generated. The Lorentz force may cause the rigid structure 402 to move on a plane that is orthogonal to the magnets 404. As the rigid structure 402 moves, the movement of the rigid structure may vibrate the pinna (or other part) of a user's ear. The vibrations may be generated according to the input signal, thereby reproducing the audio content of the input signal (e.g., words, music or other sounds) for the user.

Returning again to FIG. 4, the rigid structure 402 may move relative to the magnets 404 via one or more couplings 403. The couplings 403 may link the magnets 404 to the rigid structure 402 in a flexible manner. The flexible couplings allow the rigid structure 402 some freedom of movement, while still holding the rigid structure relatively in place. The motor 400 may also include one or more yokes or plates 401 to which the magnets and/or the couplings are connected. The plates 401 may be made of steel or other structurally solid material with sufficient magnetic permeability and a sufficiently high magnetic induction saturation value. The steel plates may include fasteners for the magnets which hold the magnets in place relative to each other. When an electrical input signal is applied to the moveable coil sandwiched between the magnets 404, the rigid structure 402 may begin to move. The plates 401 hold the magnets in place, so that substantially all of the Lorentz force generated may be transferred solely to the rigid structure 402. In this manner, the electrical input signal may cause motive force to be applied the rigid structure 402 in the frequencies specified in the input signal. As such, the rigid structure may move relative to the magnets 404 as driven by the input signal.

FIG. 5 illustrates one embodiment in which the high-efficiency motor 400 may be arranged. In the embodiment of FIG. 5, the motor 400 includes four magnets (404A-404D), where magnet 404A is placed over magnet 404B, and magnet 404C is placed over magnet 404D. Between the two pairs of magnets, the rigid structure 402 is attached to the magnets using couplings 403A-403D, respectively. Thus, for example, coupling 403A may connect the rigid structure 402 to magnet 404A, coupling 403B may connect the rigid structure to magnet 404B, and so on. Magnets 404A and 404C may be connected to one plate (401A), while magnets 404B and 404D are connected to another plate (401B).

As indicated in embodiment 600 of FIG. 6, the magnets 602 may be mounted to a yoke or plate 601, which may be the same as or different than plates 401A/401B of FIG. 5. The magnets 602 may be mounted to the plates 601 in opposite fashion, where one magnet attached to the yoke is arranged S/N, and the other magnet is arranged N/S. Correspondingly arranged magnets may be found on the opposite yoke. The coil 604 in box 603 may be the same as coil 700 of FIG. 7. The coil 604 is illustrated twice in FIG. 6. On the left side, the coil 604 is illustrated in a top view, positioned between four magnets 602, while on the right side, the coil 604 is illustrated by itself in a top view.

When the coil 604 is inserted between the magnets 602 and a current is applied, the current generates a force 605 (e.g., a Lorentz force) moves the moving coil assembly 603 (i.e., the rigid structure 402 of FIGS. 4 & 5) in the direction specified by the arrows. Because the current travels in a loop through the coil 604 and because of the arrangement of the magnet polarities, the Lorentz force is generated in the same direction even though the current is traveling in the opposite direction on the opposite side of the coil. Accordingly, as current loops through the coil 604, on one half of the coil, the magnets will generate force 605 in the direction indicated by the arrow, and when the current loops through the other half of the coil 604, the oppositely-polarized magnets will generate force 605 in the same direction. Accordingly, the force 605 moves the moving coil assembly 603 in the specified direction from a starting position to a new position. The couplings (e.g., 403A of FIG. 5) may apply a spring force that brings the moving coil assembly 603 back to its starting position. Such forces 605 may be generated many times per second, thereby causing the moving coil assembly 603 to vibrate. These vibrations are dictated by the input signal. In this manner, an input audio signal is applied to the user's pinna, which radiates the audio signal to the user's ear drum.

The embodiments and designs described herein may allow the magnets 602 to be bigger than in traditional applications or may at least allow exposure of a larger magnet face to the coil. The increased face size of the magnets may allow more energized coil conductor to be within the concentrated B-field. The embodiments herein may also allow for larger coil volumes (L) within the concentrated field. As noted above, a PCB may be used that includes traces. These traces may be relatively thin, wide traces that span the available surface of the PCB. This may provide a larger coil volume than is achievable with typical coils having an edge-wound wire. The embodiments herein allow the coil 604 to be flattened out or spread over a larger area. For instance, instead of having a wound coil that is relatively thick and may take up a great deal of space in a small form factor, the embodiments herein may implement traces which may be less than 1 mm thick. Such flattening may allow for a decreased distance between the magnetic poles of the opposing magnets. The decreased distance may result in a stronger magnetic attraction and a commensurate increase the strength of the magnetic B-field. Accordingly, in the embodiments herein, both the strength of the magnetic induction field (B) and the length of the coil (L) can be increased.

Figure 7:
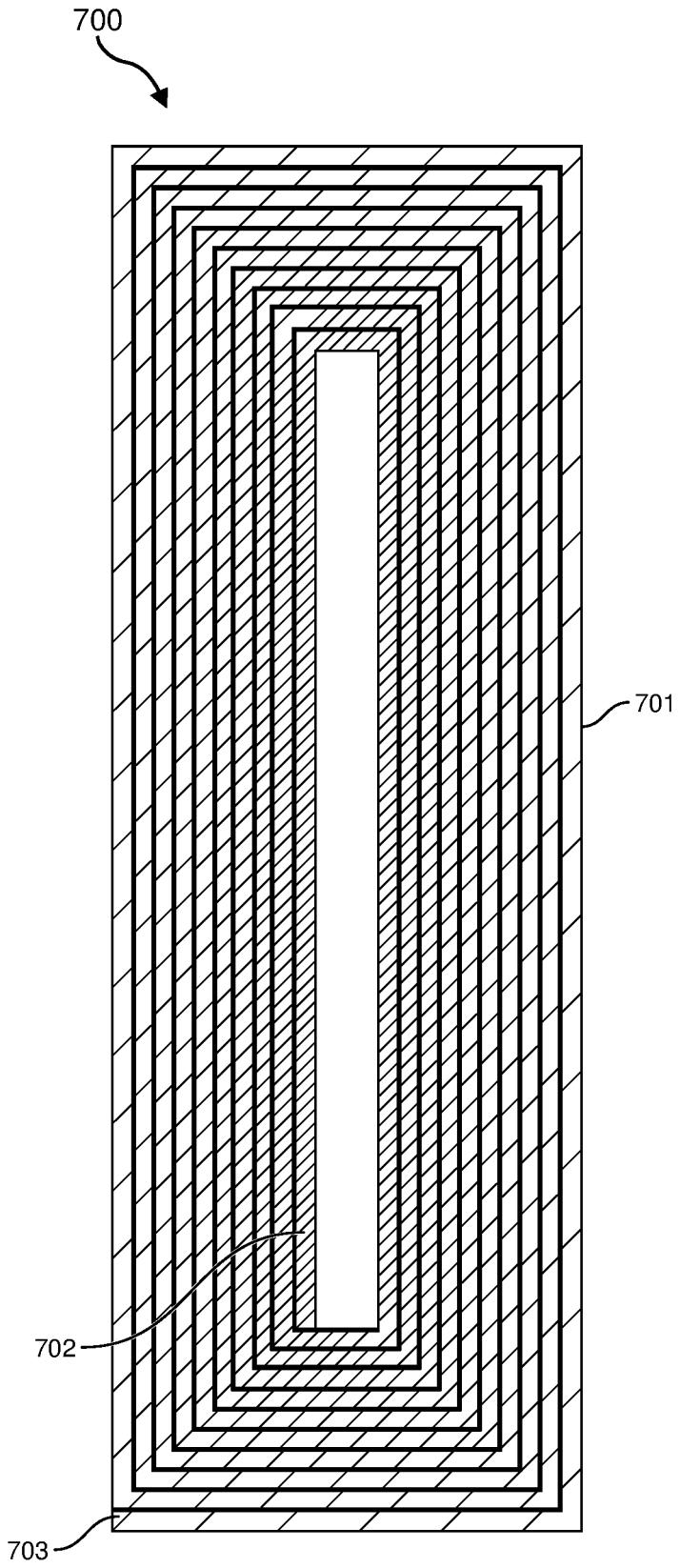
FIG. 7 illustrates an embodiment of a moveable pancake coil.

FIG. 7 illustrates an example of a moveable voice coil 700 that is made of traces 701 (or in some cases, a single trace coiled around itself). For example, in one embodiment, the moveable voice coil 700 may include a single trace with a beginning at 702 and an ending at 703. As illustrated in FIG. 7, the moveable voice coil 700 includes shading indicating a voltage drop that occurs due to the impedance of the coil. At the starting position 702, for example, the voltage will be higher (as indicated by the tightly spaced shading) than the ending position 703 of the coil (indicated by the more loosely spaced shading), this voltage drop being proportional to the impedance of the trace. Since the coil will be comprised of many layers of the flat-patterned coil, the number of layers and trace dimensions will be engineered to give a total resistance in the range of 4-320.

The traces may be relatively thin, wide traces that are configured to handle a relatively high level of current to additionally help increase the magnetic B-field. In this configuration, the increased length of the coil (L) and the increased magnetic B-field imbues the motor with the ability to generate more force for the same amount of current. Or, said another way, the motor can provide the same amount of force using less current. This may help battery-powered versions of the high-efficiency motor to last longer on the same amount of charge. Moreover, the high-efficiency motor may provide sufficient force to vibrate a user's pinna and transmit an audio signal using the user's pinna as the radiator.

Figure 8A:
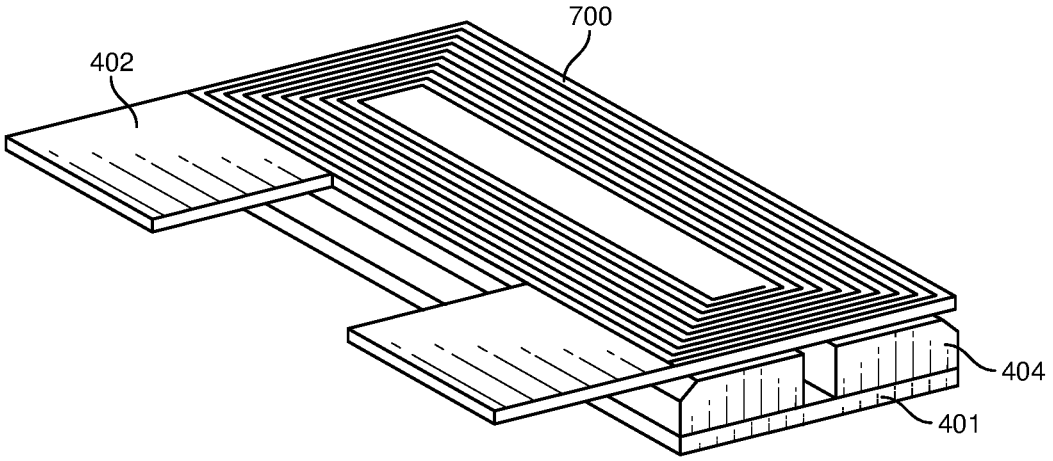
FIGS. 8A and 8B illustrate embodiments of a high-efficiency motor having one or more layers of a moveable pancake coil mounted thereon.
Figure 8B:
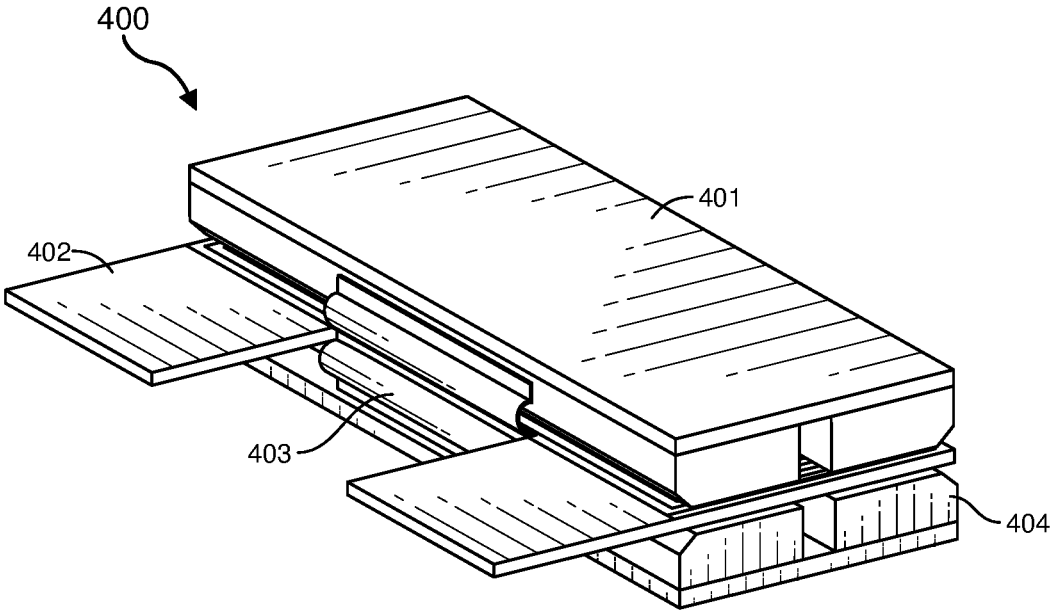

As shown in FIG. 8A, the moveable voice coil 700 may be deposited onto or etched into the rigid structure 402 of FIG. 4. The moveable voice coil may include a single pancake layer, or multiple layers connected to each other through one or more vias. For example, moveable voice coil 700 may include a single layer (as shown in FIG. 8A), 6 layers (as shown in FIG. 8B), 12 layers or some other number of layers as needed for a given implementation. The trace(s) of the moveable voice coil 700 may be applied to the PCB using any of a variety of additive or subtractive manufacturing techniques including masking, etching or similar techniques used in the semiconductor manufacturing industry. Other methods of creating traces in the PCB, including using flexible printed circuitry (FPC), may also be used. In flexible printed circuitry, a semiconductor processing machine may apply circuit patterns to a flexible insulating film and then cover the circuit patterns with a thin coating for protection. In this manner, FPC may be used to manufacture the voice coil 700. A voice coil created in this manner may then be applied to a rigid member capable of transferring the force generated by the voice coil, magnets and applied current. When magnets are placed over the moveable voice coil 700, the system is ready to reproduce an audio signal. When a current is applied to the moveable voice coil 700 from a power source (e.g., a battery), the moveable voice coil may create movement in the direction 605 shown in FIG. 6. The movements may be created according to an audio input signal. Indeed, the system may receive an audio signal and modulate the current applied to the moveable voice coil 700 to move the rigid structure 402 according to the audio signal.

Figure 9A:
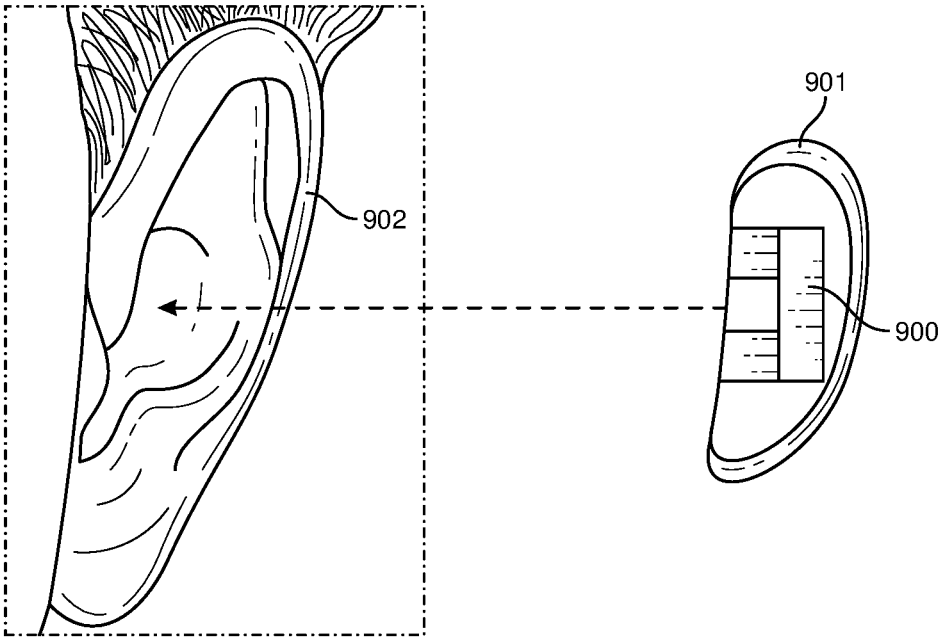
FIG. 9A illustrates an embodiment of a high-efficiency motor implemented within an inner ear piece.
Figure 9B:
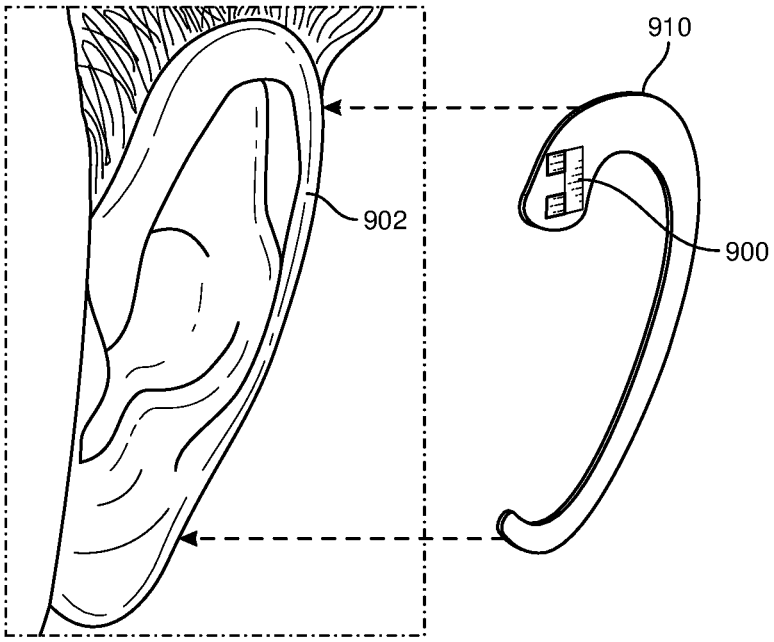
FIG. 9B illustrates an embodiment of a high-efficiency motor implemented within an outer ear piece.
Figure 9C:
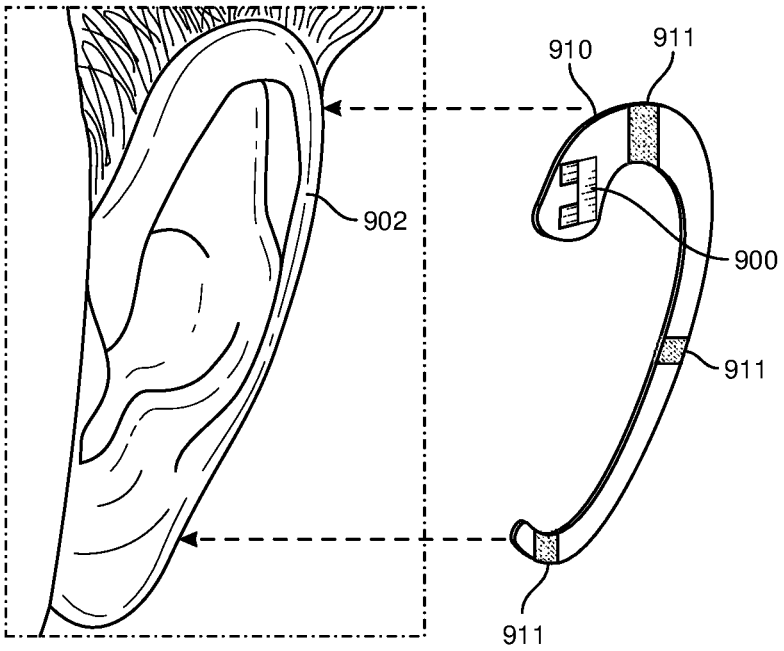
FIG. 9C illustrates an embodiment of an outer ear piece having one or more sticky pads for coupling the ear piece to the ear.

In some embodiments, as shown in FIG. 9A, the high-efficiency motor 900 may be inserted into or built into an ear piece 901 designed for insertion into a user's ear 902. In such a position, the high-efficiency motor may vibrate the rigid member such that it vibrates the user's ear 902. The system 900 may be configured to vibrate the user's pinna and/or tragal cartilage. In some cases, the rigid member of the system 900 may be faced in one direction to apply more force to the user's tragal cartilage, and in the other direction, the rigid member may apply more force to the user's pinna cartilage. FIGS. 9B and 9C illustrate an embodiment in which the high-efficiency motor is incorporated within a form factor that fits on the outside of the user's ear. In such embodiments, the outer ear piece 910 may be configured to vibrate the user's pinna from behind the ear 902. The system 910 may be coupled to an artificial reality device such as augmented reality headset 100 or 200 of FIG. 1 or 2, respectively, or to virtual reality headset 300 of FIG. 3. Alternatively, the system 910 may be coupled to the user's ear via sticky pads 911 that grip the user's skin and hold the system in place behind the user's ear.

In the embodiments shown in FIGS. 9A-9C, the systems 900/910 may include any or all of the elements shown in FIGS. 4-8. For example, the motor 400 of FIG. 4 may be implemented within the ear piece 901. The motor may include four magnets 404A-404D, as shown in FIG. 5. The magnets may be arranged with opposite magnetic polarity, as shown in FIG. 6. The magnets 404A-404D may be affixed to or a part of mounting plates 401A/401B, respectively. The magnets may be substantially any size, and each magnet may be the same size, or a different size. Similarly, the magnets may be shaped like rectangles as shown, or may be shaped like squares, circles or other shapes. In some embodiments, the mounting plates 401A/401B may be soft-magnet plates that exhibit a relatively low level of magnetic coercivity. In the ear piece 901, the magnets may be sized small enough that the motor 900 fits inside the ear piece. As such, the motor 900 may be small enough to fit within the ear piece 901 and sit comfortably inside the user's ear or between the user's ear and head. In the outer ear piece 910, the magnets, mounting plate, rigid member and couplings may similarly be sized to fit within a relatively small form factor that is light, compact and unobtrusive.

The motor 900 within the ear piece 901 may include two, four or more magnets. The magnets may be relatively long, and wide to provide a maximum amount of magnetic face over (and beneath) the voice coil 400. The trace(s) 401 may be designed in a coil such that when an input signal is applied, current flows in a clockwise manner. Indeed, as noted above with regard to FIG. 4, if an input signal is applied at the trace input 402, current may flow clockwise through the coil to the output 403. This current flow is shown in FIG. 6 where the current (i) flows in a clockwise path around the oval coil 604. When the current flows upward on the oval coil 604, it passes magnets of S/N polarity and when the current flows downward on the oval coil 604, it passes magnets of opposite N/S polarity.

Due to the Lorentz force principle, when the current passes the magnetic fields in this manner, an orthogonal Lorentz force is created. This Lorentz force 605 pushes the moving coil assembly 603 (e.g., a printed circuit board) which moves relative to the plates 901 and affixed magnets 602. The moving coil assembly 603 moves relative to the plates 901 via couplings such as flexures. These couplings (e.g., 403A-403D of FIG. 5) allow the rigid structure 402 to move when pushed by the Lorentz force 605 and then return (via spring force) to a neutral position after the Lorentz force is no longer active. Accordingly, as the Lorentz forces are repeatedly applied to the rigid structure 402 at a certain frequency, the moving coil assembly 603 will vibrate at that frequency. The mechanical movement of the rigid structure thus acts as a driver that pistonically vibrates the user's ear. When the input signal varies the frequency, the moving coil assembly will vibrate at the varied frequency, thereby recreating the audio signal in the user's ear, using the user's ear as the acoustic radiator.

Thus, in examples where the rigid structure 402 comprises a printed circuit board, the PCB may move orthogonally relative to the magnets, commensurate with an amount of energy in the electrical input signal. In such cases, a lower energy input signal may result in a smaller movement (due to a lower Lorentz force 605), and a higher energy input signal may result in a larger movement of the PCB (due to a higher Lorentz force 605). As noted above, the design of the high-efficiency motor and corresponding system described herein may allow for a flattened, moveable voice coil. This flattened, moveable voice coil (e.g., a pancake coil) may allow the magnets to be closer together, increasing the B-field. Indeed, in embodiments where magnets 404A and 404B, or 404C and 404D of FIG. 5 are closer together, the magnetic field created between the magnets may be larger. Then, when a current is applied and run between the magnets (e.g., through the voice coil 400), the Lorentz force generated will be even greater. Moreover, by using a moveable voice coil comprised of traces on a PCB, the length of the coil (L) may be longer than in older designs. In this manner, a high-efficiency electrodynamic motor may be applied which is capable of reproducing a full range of audible frequencies.

Despite having a higher B-field and a longer coil length, the embodiments described herein may still fit into an ear piece such as ear piece 901 of FIG. 9. The ear piece 901 may vibrate the user's pinna and/or tragal cartilage in their ear 902 to reproduce an audio source signal. The audio source signal may include speech, music or substantially any other noise or sound. The embodiments herein may be designed to provide a range in vibrations to the user's pinna that can replicate any audible frequency.

In some cases, the motor 400 may include a ferrofluid that dissipates heat within the system. Current flowing through the moveable voice coil 400 may generate heat, especially in compact devices such as ear pieces. The ferromagnetic fluid or "ferrofluid" may be implemented within the motor 400 to reduce heat within the system. The ferrofluid may include a carrier such as oil or water and may include nanometer-sized magnetic particles (e.g., iron oxide) that are suspended in the carrier. Various types of surfactants such as oleic acid or soy lecithin may be used to keep the magnetic particles from binding to each other. Due to the increased about of B-field within the motor 400, the magnetic B-field may be high enough to keep the ferrofluid within the system, even if the system is dropped or bumped. Moreover, at least in some embodiments, the B-field within the motor 400 may be high enough to keep the ferrofluid within the motor even if the system is unsealed. Thus, a higher B-field may allow ferrofluid to be implemented within the ear piece 901 to cool the electrodynamic motor.

Still further, in some embodiments, metal flexures may be used to connect the rigid structure 402 to the magnets 404. In cases where metal flexures are used, the metal may serve as electrical contacts for the coil 400. When serving as electrical contacts for the coil 400, the metal flexures may carry the electrical current input to the coil. In some cases, the flexures may be made from spring steel, polyether ether ketone (PEEK) laminate or some other metal alloy or thermoplastic resin. Any of the above-described embodiments and variations may be used in the method 1000 of FIG. 10, described in greater detail below.

Figure 10:
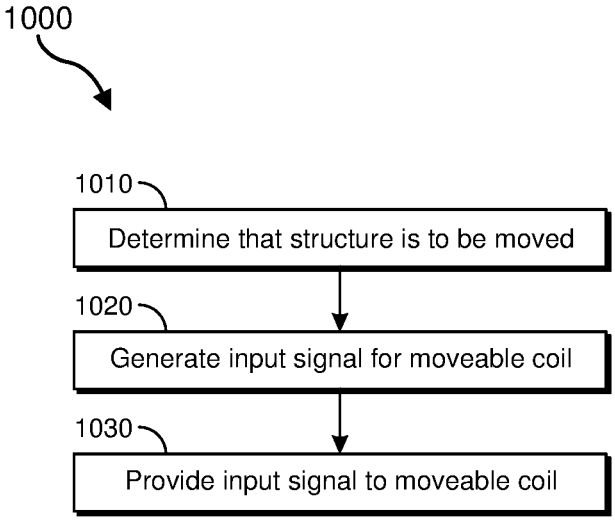
FIG. 10 illustrates a flow diagram of an exemplary method for reproducing an audio source using a pistonic acoustic radiator.

FIG. 10 is a flow diagram of an exemplary computer-implemented method 1000 for reproducing an audio source using a user's ear as an acoustic radiator. The steps shown in FIG. 10 may be performed by any suitable computer-executable code and/or computing system, including the system(s) illustrated in FIG. 8. In one example, each of the steps shown in FIG. 10 may represent an algorithm whose structure includes and/or is represented by multiple sub-steps, examples of which will be provided in greater detail below.

As illustrated in FIG. 10, one or more of the systems described herein may be implemented to reproduce an audio source using a user's ear as an acoustic radiator. At step 1010, a processor, controller or other computing device may determine that a rigid structure is to be moved in a specified manner. The rigid structure (e.g., 402 of FIG. 5) may be arranged between at least two magnets (e.g., 404A and 404B). The rigid structure 402 may include traces 401 configured to act as a moveable coil 400.

Continuing method 1000, at step 1020, the processor or controller may generate an input signal that is to be applied to the moveable coil 400. The moveable coil 400 may be configured to apply a motive force to the rigid structure 402 according to the generated input signal. The method may then include, at step 1030, providing the generated input signal to the moveable coil 400, so that the rigid structure 402 is moved in the specified manner. The generated input signal may be modulated according to an audio signal that is to be transmitted to a listener. The rigid structure may then be moved or vibrated according to the modulated audio signal and according to the Lorentz forces generated by the current flowing through the moveable voice coil 400.

In some embodiments, the audio signal may be received and/or modified by a processor or controller within the ear piece. For example, in cases where the inner ear piece 901 is configured to act as a hearing aid, the ear piece may include a microphone that listens for exterior sounds and electronic components that amplify those sounds for the listening user. Thus, the motor 600 may include embedded electronic components that receive signals from a microphone, amplify those signals, and pass those signals on to the user by generating corresponding vibrations. In other cases, the inner ear piece 901 may receive an audio signal from a mobile device such as a smart phone. The audio signal may be received via one or more radios built into the inner ear piece 901, including Bluetooth, WiFi or cellular radios. Once received, the audio signal or audio stream may be used to modulate current that is applied to the voice coil. This modulated current applies Lorentz forces to the rigid structure (e.g., the PCB) in the manner indicated in the audio signal. The Lorentz forces create vibrations in the ear piece and correspondingly in the user's ear. In this manner, the inner ear piece 901 (including the high-efficiency motor 600) may reproduce audio signals by pistonically radiating those signals through the user's ear.

In some examples, the above-described method may be encoded as computer-readable instructions on a computer-readable medium. For example, a computer-readable medium (e.g., flash memory embedded in the ear piece 901) may include one or more computer-executable instructions that, when executed by at least one processor of a computing device, may cause the computing device to determine that a rigid structure is to be moved in a specified manner. The rigid structure may be arranged between at least two magnets, and the rigid structure may include traces configured to act as a moveable coil. The computing device may then generate an input signal that is to be applied to the moveable coil. The moveable coil may be configured to apply a motive force to the rigid structure according to the generated input signal. The computing device may then provide the generated input signal to the moveable coil, so that the rigid structure is moved in the specified manner.

FIG. 8 illustrates a block diagram of a computer system that may be used to implement features of some of the embodiments, e.g., to implement the content provisioning module. The computing system 800 may include one or more central processing units ("processors") 805, memory 810, input/output devices 825 (e.g., keyboard and pointing devices, display devices), storage devices 820 (e.g., disk drives), and network adapters 830 (e.g., network interfaces) that are connected to an interconnect 815. The interconnect 815 is illustrated as an abstraction that represents any one or more separate physical buses, point to point connections, or both connected by appropriate bridges, adapters, or controllers. The interconnect 815, therefore, may include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus, also called "Firewire."

The memory 810 and storage devices 820 may represent computer-readable storage media that may store instructions that implement at least portions of the various embodiments. In addition, the data structures and message structures may be stored or transmitted via a data transmission medium, e.g., a signal on a communications link. Various communications links may be used, e.g., the Internet, a local area network, a wide area network, or a point-to-point dial-up connection. Thus, computer readable media can include computer-readable storage media (e.g., "non-transitory" media) and computer-readable transmission media.

The instructions stored in memory 810 can be implemented as software and/or firmware to program the processor(s) 805 to carry out actions described above. In some embodiments, such software or firmware may be initially provided to the processing system 800 by downloading it from a remote system through the computing system 800 (e.g., via network adapter 830).

Accordingly, the systems and embodiments herein may be used to reproduce audio for a user using an electrodynamic motor that has a high magnetic B-field and a long coil length. The embodiments described herein allow for larger magnets placed closer together to create a larger B-field. The embodiments herein also allow for wide, thin traces to be used as a moveable voice coil, thereby improving the length of the coil (L). Accordingly, the electrodynamic BL motor described herein may have a better ability to reproduce a wide spectrum of audio signals as a result of its higher magnetic B-field and longer coil length.

Moreover, it should be noted that while the high-efficiency motor has been chiefly described in conjunction with a system that drives a user's ear cartilage as the radiator, the high-efficiency motor may be used in a wide variety of different applications. For instance, the high-efficiency motor may be used in headphones, Bluetooth devices, artificial reality devices, haptics modules, hearing aids, vibration alert devices, or any other implementation where such Lorentz forces are to be generated and applied. Indeed, while many of the embodiments described herein are designed for a small form factor, each of the components herein may be designed and manufactured in much larger sizes for other uses such as in loudspeakers, solenoids or other applications where a Lorentz force may be applied to a rigid member and cause that rigid member to perform some type of work.

As detailed above, the computing devices and systems described and/or illustrated herein broadly represent any type or form of computing device or system capable of executing computer-readable instructions, such as those contained within the modules described herein. In their most basic configuration, these computing device(s) may each include at least one memory device and at least one physical processor.

In some examples, the term "memory device" generally refers to any type or form of volatile or non-volatile storage device or medium capable of storing data and/or computer-readable instructions. In one example, a memory device may store, load, and/or maintain one or more of the modules described herein. Examples of memory devices include, without limitation, Random Access Memory (RAM), Read Only Memory (ROM), flash memory, Hard Disk Drives (HDDs), Solid-State Drives (SSDs), optical disk drives, caches, variations or combinations of one or more of the same, or any other suitable storage memory.

In some examples, the term "physical processor" generally refers to any type or form of hardware-implemented processing unit capable of interpreting and/or executing computer-readable instructions. In one example, a physical processor may access and/or modify one or more modules stored in the above-described memory device. Examples of physical processors include, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, or any other suitable physical processor.

Although illustrated as separate elements, the modules described and/or illustrated herein may represent portions of a single module or application. In addition, in certain embodiments one or more of these modules may represent one or more software applications or programs that, when executed by a computing device, may cause the computing device to perform one or more tasks. For example, one or more of the modules described and/or illustrated herein may represent modules stored and configured to run on one or more of the computing devices or systems described and/or illustrated herein. One or more of these modules may also represent all or portions of one or more special-purpose computers configured to perform one or more tasks.

In addition, one or more of the modules described herein may transform data, physical devices, and/or representations of physical devices from one form to another. For example, one or more of the modules recited herein may receive data to be transformed, transform the data, output a result of the transformation to perform a function, use the result of the transformation to perform a function, and store the result of the transformation to perform a function. Additionally or alternatively, one or more of the modules recited herein may transform a processor, volatile memory, non-volatile memory, and/or any other portion of a physical computing device from one form to another by executing on the computing device, storing data on the computing device, and/or otherwise interacting with the computing device.

In some embodiments, the term "computer-readable medium" generally refers to any form of device, carrier, or medium capable of storing or carrying computer-readable instructions. Examples of computer-readable media include, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

Embodiments of the instant disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the instant disclosure. The embodiments disclosed herein should be considered in all respects illustrative and not restrictive. Reference should be made to the appended claims and their equivalents in determining the scope of the instant disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

I claim:

1. A computer-implemented method comprising:

determining that a rigid structure is to be moved in a specified manner, the rigid structure being arranged between at least two magnets, the rigid structure comprising one or more traces configured to act as a moveable coil, wherein the traces include a plurality of separate layers, and wherein the separate layers are connected to each other through one or more separate vias;

generating an input signal that is to be applied to the moveable coil, the moveable coil being configured to apply a motive force to the rigid structure according to the generated input signal; and providing the generated input signal to the moveable coil, such that the rigid structure is moved in the specified manner.

2. The computer-implemented method of claim 1, wherein the rigid structure has an ear piece attached thereto.

3. The computer-implemented method of claim 2, wherein the ear piece is configured to vibrate a listener's pinna and/or tragal cartilage according to the generated input signal.

4. The computer-implemented method of claim 3, wherein the vibrations to the listener's pinna and/or tragal cartilage transmit an audio signal that is heard by the listener.

5. The computer-implemented method of claim 1, wherein the generated input signal is modulated according to an audio signal that is to be transmitted to a listener.

6. The computer-implemented method of claim 1, wherein the rigid structure is attached to the magnets using one or more metal or thermoformed plastic flexures.

7. The computer-implemented method of claim 6, wherein the metal or thermoformed plastic flexures operate as electrical contacts for the moveable coil.

8. A non-transitory computer-readable medium comprising one or more computer-executable instructions that, when executed by at least one processor of a computing device, cause the computing device to:

determine that a rigid structure is to be moved in a specified manner, the rigid structure being arranged between at least two magnets, the rigid structure comprising one or more traces configured to act as a moveable coil, wherein the traces include a plurality of separate layers, and wherein the separate layers are connected to each other through one or more separate vias;

generate an input signal that is to be applied to the moveable coil, the moveable coil being configured to apply a motive force to the rigid structure according to the generated input signal; and provide the generated input signal to the moveable coil, such that the rigid structure is moved in the specified manner.

9. The non-transitory computer-readable medium of claim 8, wherein the at least two magnets are arranged opposite each other, each magnet having an aligned magnetic polarity.

10. The non-transitory computer-readable medium of claim 8, wherein the rigid structure further comprises a mounting plate to which at least one of the magnets is mounted, the mounting plate providing a magnetic return path.

11. The non-transitory computer-readable medium of claim 10, wherein the rigid structure houses at least four magnets, wherein two of the magnets are mounted to a first soft-magnet plate on a first side of the rigid structure, and wherein two of the magnets are mounted to a second soft-magnet plate on a second side of the rigid structure, which is opposite the first side of the rigid structure.

12. The non-transitory computer-readable medium of claim 11, wherein the rigid structure includes at least two couplings, wherein each of the two couplings is respectively connected to one of the four magnets and to the rigid structure.

13. The non-transitory computer-readable medium of claim 11, wherein the rigid structure comprises a printed circuit board.

14. The non-transitory computer-readable medium of claim 13, wherein the printed circuit board moves orthogonally relative to the magnets, commensurate with an amount of energy in the generated input signal.

15. The non-transitory computer-readable medium of claim 13, wherein one or more traces are applied to the printed circuit board using a pattern of conductive traces within a flexible printed circuit (FPC) that is bonded to the rigid structure.

16. A system comprising:

at least one physical processor;

physical memory comprising computer-executable instructions that, when executed by the physical processor, cause the physical processor to:

determine that a rigid structure is to be moved in a specified manner, the rigid structure being arranged between at least two magnets, the rigid structure comprising one or more traces configured to act as a moveable coil, wherein the traces include a plurality of separate layers, and wherein the separate layers are connected to each other through one or more separate vias;

generate an input signal that is to be applied to the moveable coil, the moveable coil being configured to apply a motive force to the rigid structure according to the generated input signal; and provide the generated input signal to the moveable coil, such that the rigid structure is moved in the specified manner.

17. The system of claim 16, wherein the rigid structure has an ear piece attached thereto.

18. The system of claim 17, wherein the ear piece is configured to vibrate a listener's pinna and/or tragal cartilage according to the generated input signal.

19. The system of claim 18, wherein the vibrations to the listener's pinna and/or tragal cartilage transmit an audio signal that is heard by the listener.

20. The system of claim 16, wherein the generated input signal is modulated according to an audio signal that is to be transmitted to a listener.

* * * * *